US006543921B2

(12) United States Patent
Natsume

(10) Patent No.: US 6,543,921 B2
(45) Date of Patent: Apr. 8, 2003

(54) VEHICULAR INDICATOR LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/731,703

(22) Filed: Dec. 8, 2000

(65) Prior Publication Data

US 2001/0003506 A1 Jun. 14, 2001

(30) Foreign Application Priority Data

Dec. 8, 1999 (JP) ..... 11-349517

(51) Int. Cl.[7] ..... F21V 7/00

(52) U.S. Cl. ..... 362/518; 362/509; 362/516; 362/517; 362/519; 362/347; 362/348; 362/296; 362/297; 362/346

(58) Field of Search ..... 362/518, 509, 362/516, 517, 519, 347, 348, 296, 297, 346, 304

(56) References Cited

U.S. PATENT DOCUMENTS 5,975,723 A * 11/1999 Daumueller et al. ..... 362/297
6,070,993 A * 6/2000 Natsume ..... 362/309
6,280,064 B1 * 8/2001 Sato et al. ..... 362/257

* cited by examiner

*Primary Examiner*—Sandra O'Shea
*Assistant Examiner*—Bertrand Zeade
(74) *Attorney, Agent, or Firm*—Sughrue Mion, PLLC

(57) ABSTRACT

A vehicular indicator lamp that provides an observer with a novel visual impression even when the point of observation is moved either horizontally or vertically while ensuring clarity of the lamp. A reflective surface of a reflector is divided in an orthogonal grid into a plurality of segments, each of which is allocated a reflective element. The reflective surface is formed as a two-dimensional wavy surface in which concave surface reflective elements and convex surface reflective elements are alternatingly repeated in each of two directions. As a result, in the case where the reflective surface of the lamp is viewed from the front, when the point of observation is moved horizontally or vertically, the brightness pattern of the reflective surface changes dynamically to accompany the movement of the point of observation, causing the observer to perceive a strong glittering sensation.

12 Claims, 12 Drawing Sheets

VEHICULAR INDICATOR LAMP

BACKGROUND OF THE INVENTION

The present invention relates to a vehicular indicator lamp, and particularly to the structure of the reflective surface of the reflector of a vehicular indicator lamp.

In recently designed vehicular indicator lamps a transparent lens has been used for the front lens for imparting a visual impression of clarity to the lamp, while the reflective surface of the reflector has commonly been formed with a plurality of fisheye-lens-shaped reflective elements so as to provide desired light distribution properties for the lamp.

When this type of lamp is viewed from the front, the reflective elements appear through the transparent lens to shine in a scattered pattern. However, when the point of observation is moved from a position directly in front of the lamp up or down or to the left or right, there is practically no change in the observed brightness pattern of the reflective surface. It has been desired though to provide a better visual impression to the observer and to enhance the design originality of the lamp.

Accordingly, as shown in FIG. 12, a vehicular lamp has been proposed in which the reflective surface 2*a* of a reflector 2 is formed of a plurality of reflective elements 2*s* arranged in a pattern of vertical stripes, with the horizontal cross section thereof being established as a wavy pattern of predetermined shape. With this lamp, when the point of observation is moved from a position directly in front of the lamp to the left or right, the observed brightness pattern of the reflective surface 2*a* will change.

However, even in a lamp structure having this type of vertically striped wavy reflective surface, when the point of observation is vertically moved from a position directly in front of the lamp, there is practically no change in the observed brightness pattern of the-reflective surface 2*a*. As a result, improvements in the design originality of the lamp are still desired.

Moreover, concerning the light distribution properties of a vehicular indicator lamp, it is necessary to irradiate light that is diffused not only in the horizontal direction but also in the vertical direction to the front of the lamp. If the above-described reflector structure that has a vertically striped wavy reflective surface is employed, a problem arises in that, as shown in FIG. 12, it becomes necessary to additionally provide diffusion lens elements 4*s* arranged in horizontal stripes on the inner surface of the front lens 4, as a result of which the visual impression of clarity of the lamp is diminished.

SUMMARY OF THE INVENTION

The present invention has been conceived in consideration of the foregoing situation. Accordingly, it is an object of the invention to provide a vehicular indicator lamp that provides a novel visual impression to an observer when the point of observation is moved either horizontally or vertically, while ensuring a visual impression of clarity.

The present invention achieves the aforementioned object by a novel design of the configuration of the cross section of the reflective surface of the reflector.

More specifically, the vehicular indicator lamp according to the present invention is provided with a light source bulb, a reflector having a reflective surface for reflecting light from the light source bulb forward, and a front lens provided forward of the reflector, which is characterized in that the reflective surface is divided into a plurality of segments in a grid pattern, each of which is allocated a reflective element, and the reflective surface is formed as a two-dimensional wavy surface in which concave surface reflective elements and convex surface reflective elements are alternately repeated in two directions along the grid.

There is no particular limitation on the pattern of the above-mentioned grid. For example, it is possible to employ an orthogonal grid formed by two straight lines orthogonal to one another, a slanted grid in which the lines intersect at a slant, an annular grid formed from a plurality of straight lines arranged in a radial shape, and a plurality of curved lines arranged in a concentric shape.

Provided that adjacent concave surface reflective elements and convex surface reflective elements are connected together with no difference in height therebetween in either grid direction, the two-dimensional wavy surface may be a surface on which a line is created at the portion connecting the two types of reflective elements. Moreover, there is no particular restriction concerning the value of the radius of curvature of each concave surface reflective element and each concave surface reflective element forming the two-dimensional wavy surface. Furthermore, the two-dimensional wavy surface may be applied to the entirety of the reflective surface or to only a portion of the reflective surface As described above, the reflective surface of the reflector of the vehicular indicator lamp according to the invention is formed by dividing the reflective surface into a plurality of segments in a grid pattern, each of which is allocated a reflective element. The reflective surface is formed as a two-dimensional wavy surface in which concave surface reflective elements and convex surface reflective elements are alternately repeated in two directions along the grid, thus providing the following operation and effect.

Namely, in the case where the reflective surface of the illuminated lamp is viewed from the front, if the point of observation is moved vertically or horizontally, the bright portions (i.e., those portions where light from the light source bulb is reflected and appears to shine) of the convex surface reflective elements move in the same direction as the direction in which the point of observation has moved. In contrast, the bright portions of the concave surface reflective elements move in the opposite direction to the direction in which the point of observation has moved. Therefore, the brightness pattern of the reflective surface changes dynamically to accompany the movement of the point of observation, and the brightness pattern as seen from directly in front of the lamp, the brightness pattern as seen from the left side (or from the top), and the brightness pattern as seen from the right side (or from the bottom) are all different. Moreover, the brightness pattern of the reflective surface changes dynamically as the point of observation changes, which allows the observer to perceive a strong glittering sensation.

Even in the OFF state of the lamp, when light irradiated from outside the lamp is reflected by the reflective elements, the resultant brightness pattern changes as the point of observation moves. This provides the observer with a strong glittering sensation.

Moreover, because the above-described reflective surface is formed as a two-dimensional wavy surface, it is possible to obtain light that is diffused in both the vertical and horizontal directions from the reflected light of the reflector. As a result, the front lens can be formed from a transparent or substantially transparent lens. It is therefore possible to ensure the impression of clarity of the lamp.

According to the present invention where the impression of clarity of the lamp is ensured, even if the point of observation is moved in either the vertical or horizontal directions, a novel impression is given to the observer, and consequently the appearance of the lamp is improved.

The pitches of the above-mentioned segments may be either uniform or varied. In the latter case, if the pitch of the segments gradually increases away from the optical axis of the reflector, the interval between bright portions increases away from the optical axis of the reflector. As a result, it is possible to give an impression of depth to the observer.

In the above-described structure, if the two-dimensional wavy surface is formed with a paraboloid of revolution as a reference surface having the optical axis of the reflector as its central axis, it is possible to diffuse reflected light from the reflector vertically and horizontally around the optical axis. Therefore, it is possible to easily obtain the desired lamp light distribution properties.

DESCRIPTION OF THE PREFERRED EMBODIMENTS

Figure 1:
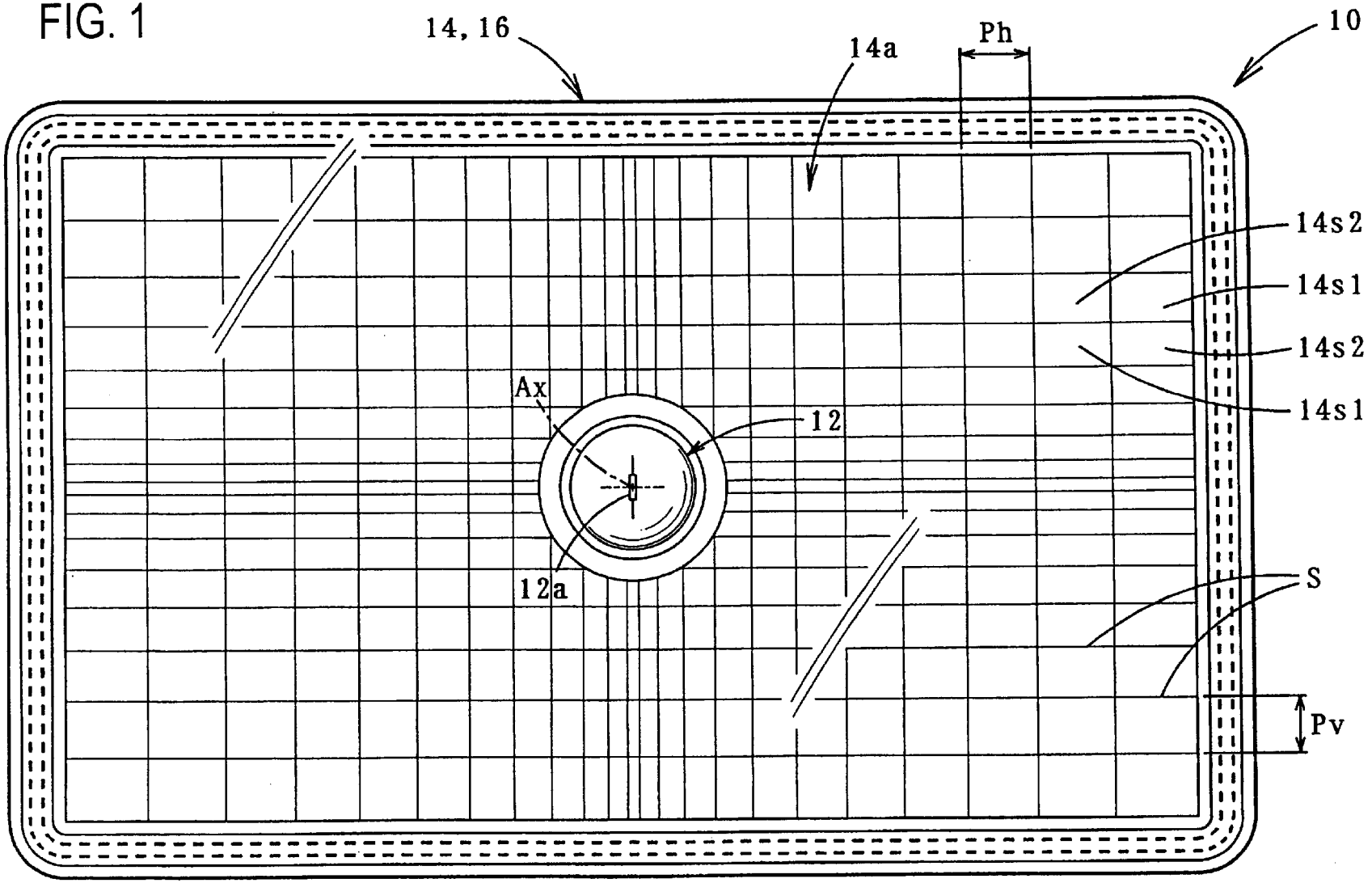
FIG. 1 is a front view showing a vehicular indicator lamp according to a first embodiment of the present invention.

Preferred embodiments of the present invention will now be described referring to the drawings.

A first embodiment of the present invention now will be described.

Figure 2:
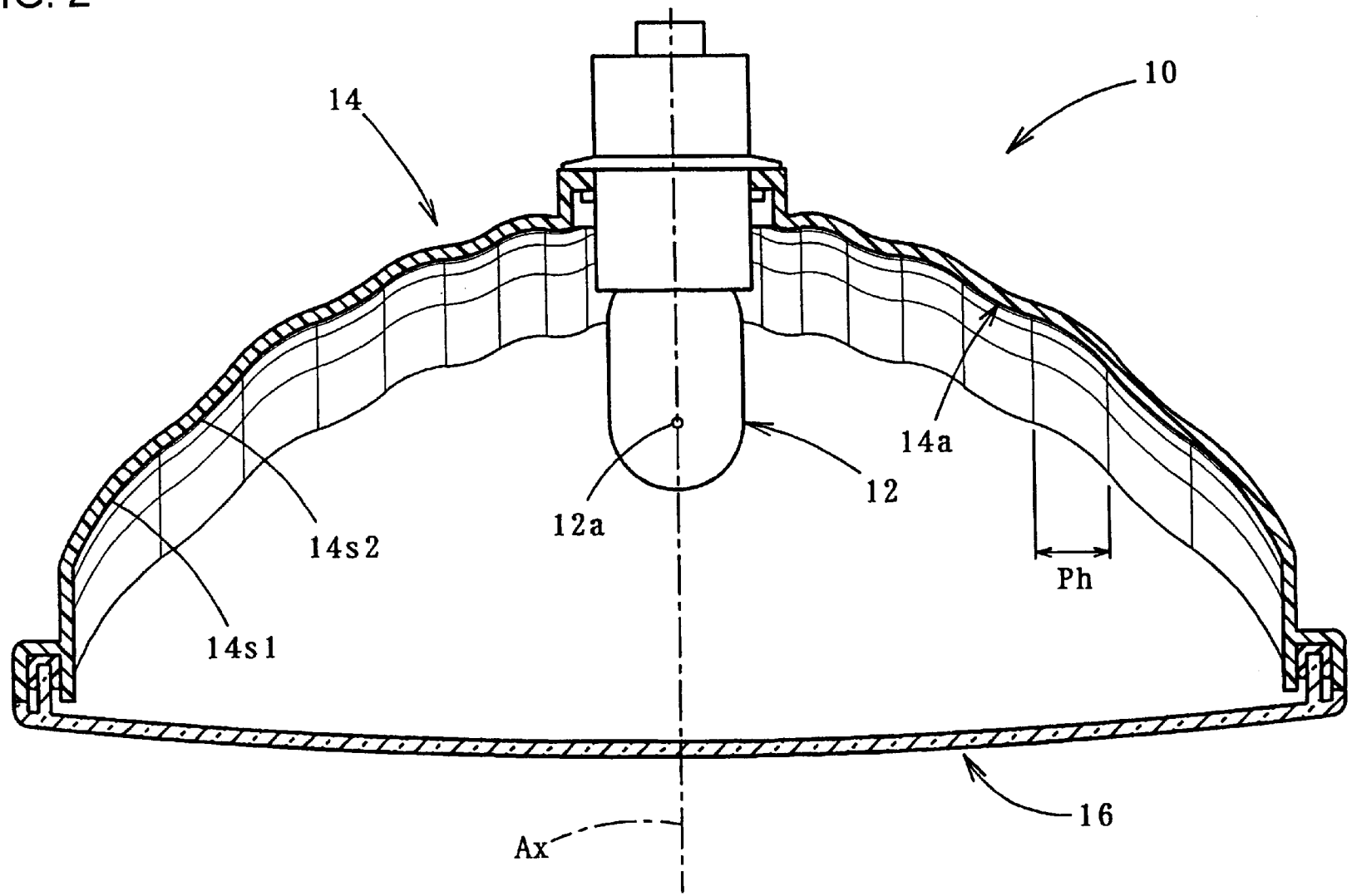
FIG. 2 is a top cross-sectional view showing the vehicular indicator lamp according to the first embodiment.
Figure 3:
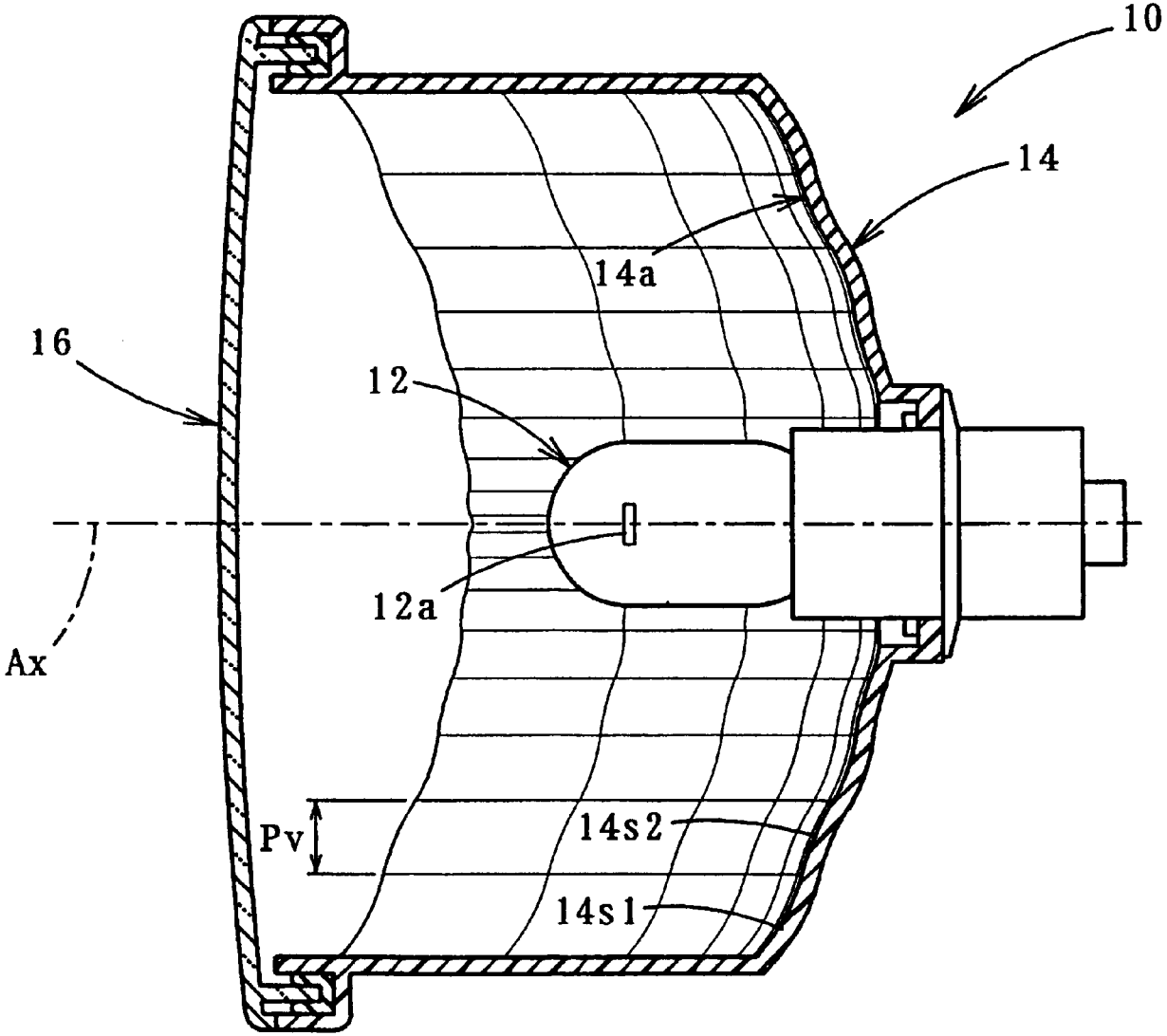
FIG. 3 is a side cross-sectional view showing the vehicular indicator lamp according to the first embodiment.

FIG. 1 is a front view showing a vehicular indicator lamp constructed according to the first embodiment. FIGS. 2 and 3 are, respectively, top cross-sectional and side cross-sectional views thereof.

As shown in these figures, a vehicular indicator lamp 10 according to the present embodiment is a tail lamp installed at the rear end portion of the body of a vehicle. The lamp 10 is provided with a light source bulb 12 having a filament 12*a* extending in the vertical direction of the vehicle, a reflector 14 having a reflective surface 14*a* that supports the light source bulb 12 and diffuses and reflects light from the light source bulb 12 forward (i.e., in the forward direction relative to the lamp and in the rearward direction relative to the vehicle; the same applies to the subsequent description), and a transparent front lens 16 provided forward of the reflector 14 and attached thereto. The vehicular indicator lamp 10 is shaped with a transversely elongated rectangular outline.

Figure 4:
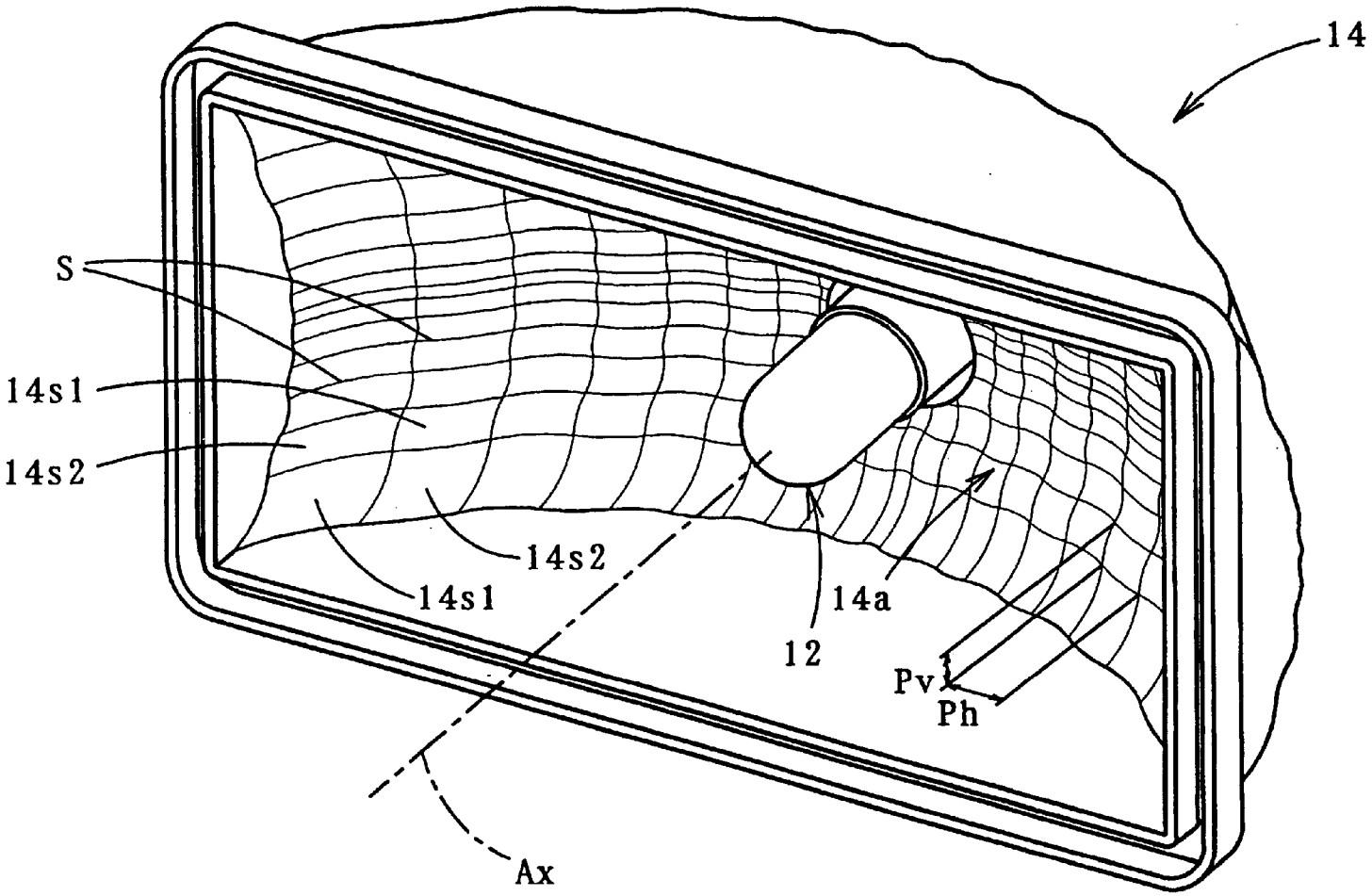
FIG. 4 is a perspective view showing the reflector of the first embodiment.
Figure 5B:
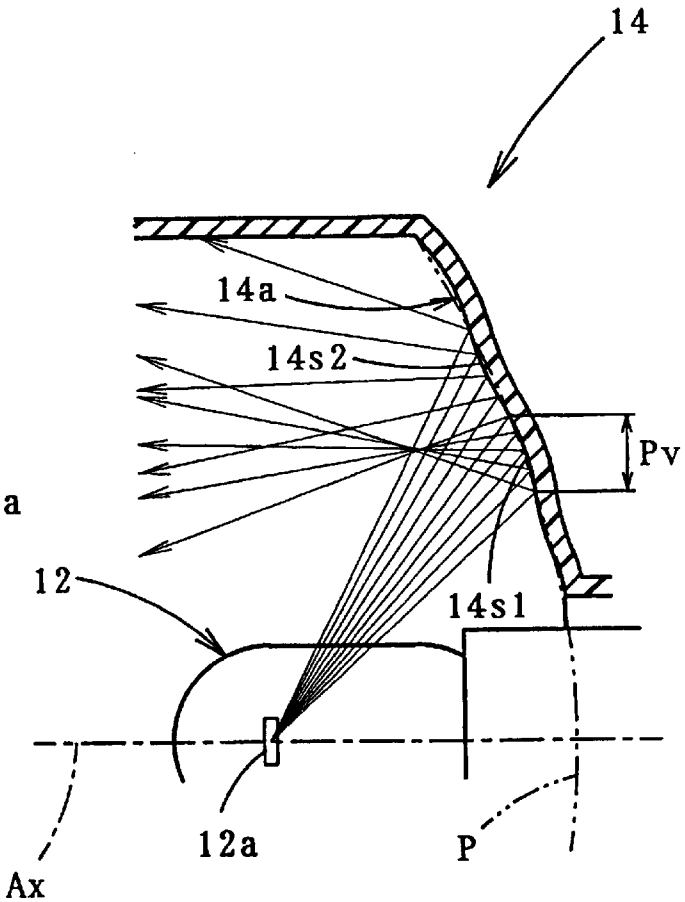
FIG. 5B is a sectional side elevation view each showing main portions of the reflector of the first embodiment.
Figure 5A:
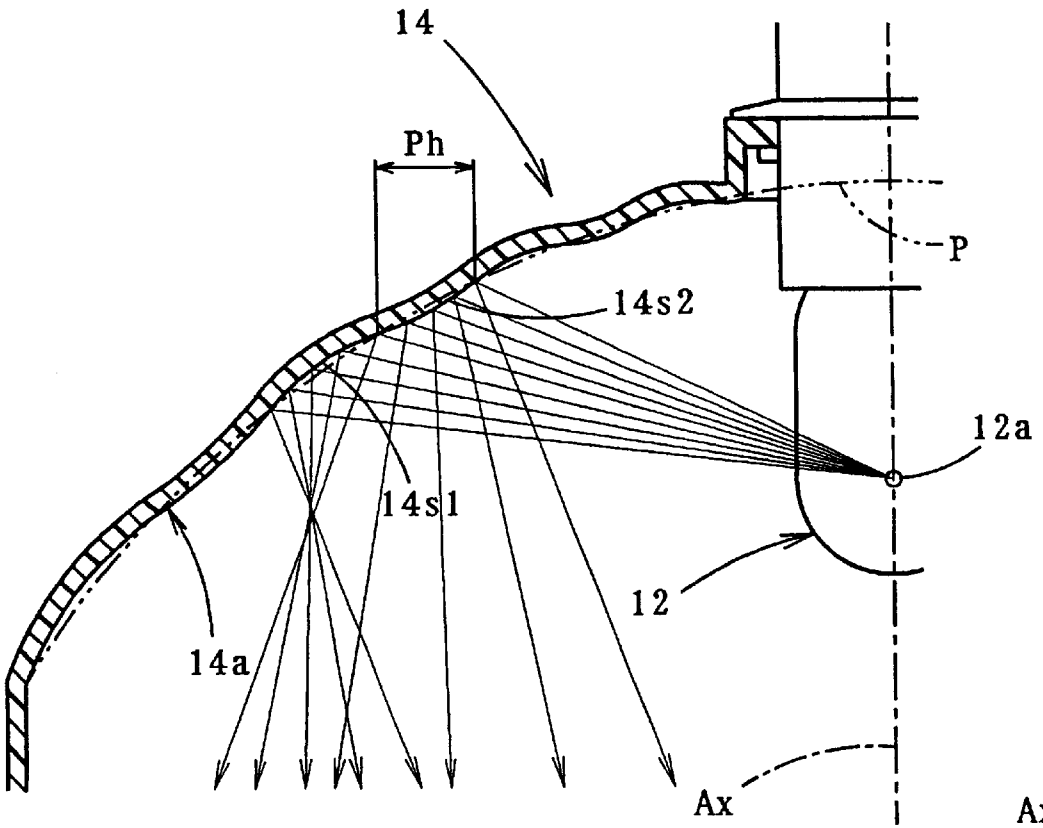
FIG. 5A is a top sectional view.

FIG. 4 is a perspective view showing the reflector 14. FIG. 5A is a top cross-sectional view and FIG. 5B is a side cross-sectional view of essential portions of the reflector 14.

As shown in the drawings, the entire reflective surface 14*a* of the reflector 14 is divided into a plurality of segments S in a vertically and horizontally orthogonal grid pattern. Moreover, the reflective surface 14*a* is formed as a two-dimensional wavy surface on which the segments S are apportioned in the vertical and horizontal directions into alternating concave surface reflective elements 14*s*1 and convex surface reflective elements 14*s*2. The two-dimensional wavy surface is formed with a paraboloid of revolution P as its reference surface having the optical axis Ax of the reflector 14 as a central axis and with the position of the filament 12*a* aligned with the focal point of the paraboloid of revolution P. Namely, the concave surface reflective elements 14*s*1 are formed as recess surfaces relative to the paraboloid of revolution P, while convex surface reflective elements 14*s*2 are formed as projecting surfaces relative to the paraboloid of revolution P. Moreover, adjacent concave surface reflective elements 14*s*1 and convex surface reflective elements 14*s*2 are joined together with no height difference therebetween. The pitch Pv of the segments S in the vertical direction and the pitch Ph of the segments S in the horizontal direction become gradually larger the further removed they are from the optical axis Ax of the reflector 14 in the vertical and horizontal directions, respectively.

As shown in FIG. 5, each concave surface reflective element 14*s*1 and each convex surface reflective element 14*s*2 has a vertical diffusion function and a horizontal diffusion function. When the reflective surface 14*a* is viewed from the outside of the lamp, the reflecting surface 14*a* appears to glitter, as described below in more detail.

Figure 6:
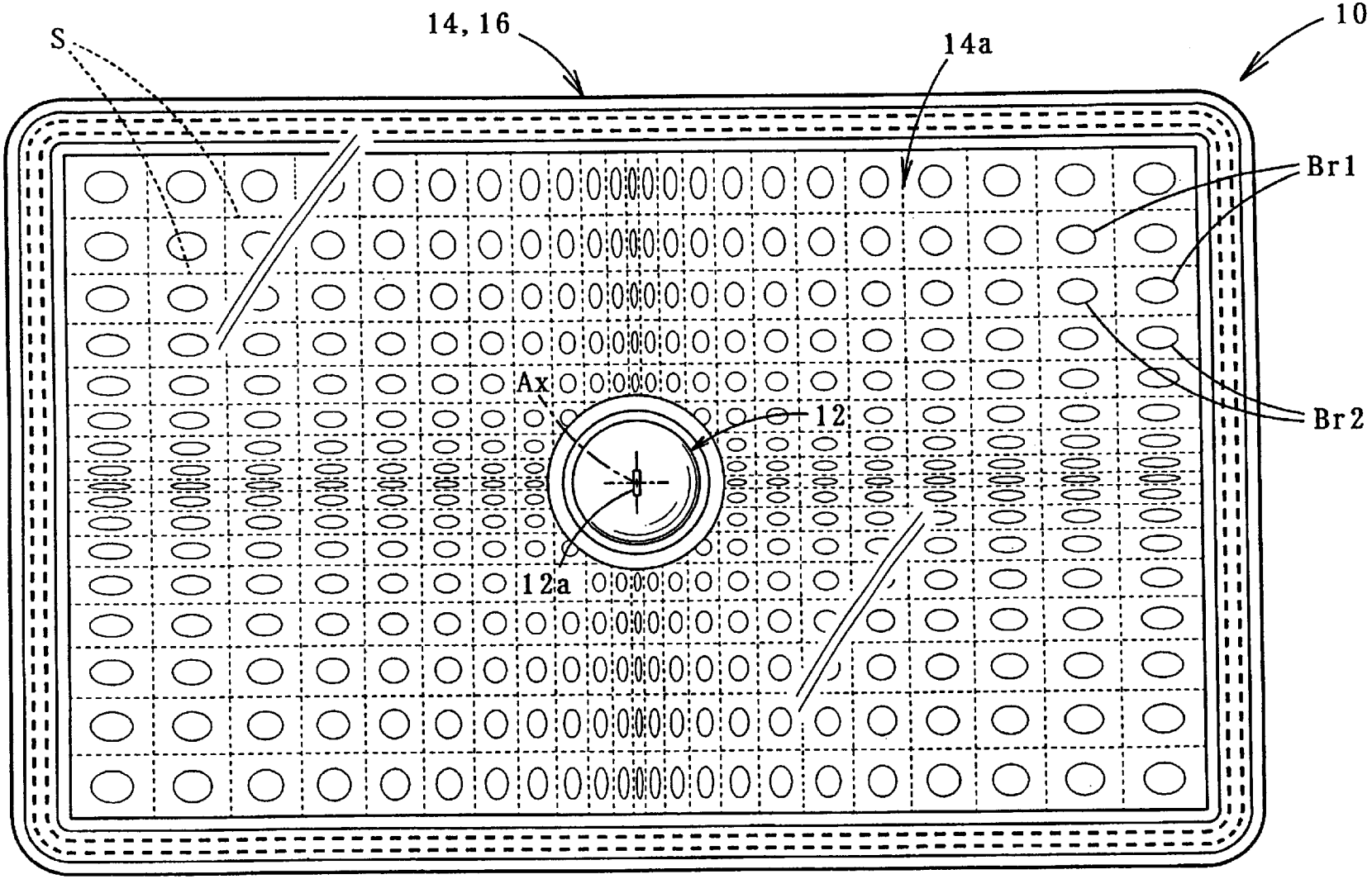
FIG. 6 is a view observed from directly in front of the lamp showing the appearance of the reflective surface in an ON state of the light source bulb in the first embodiment.
Figure 7:
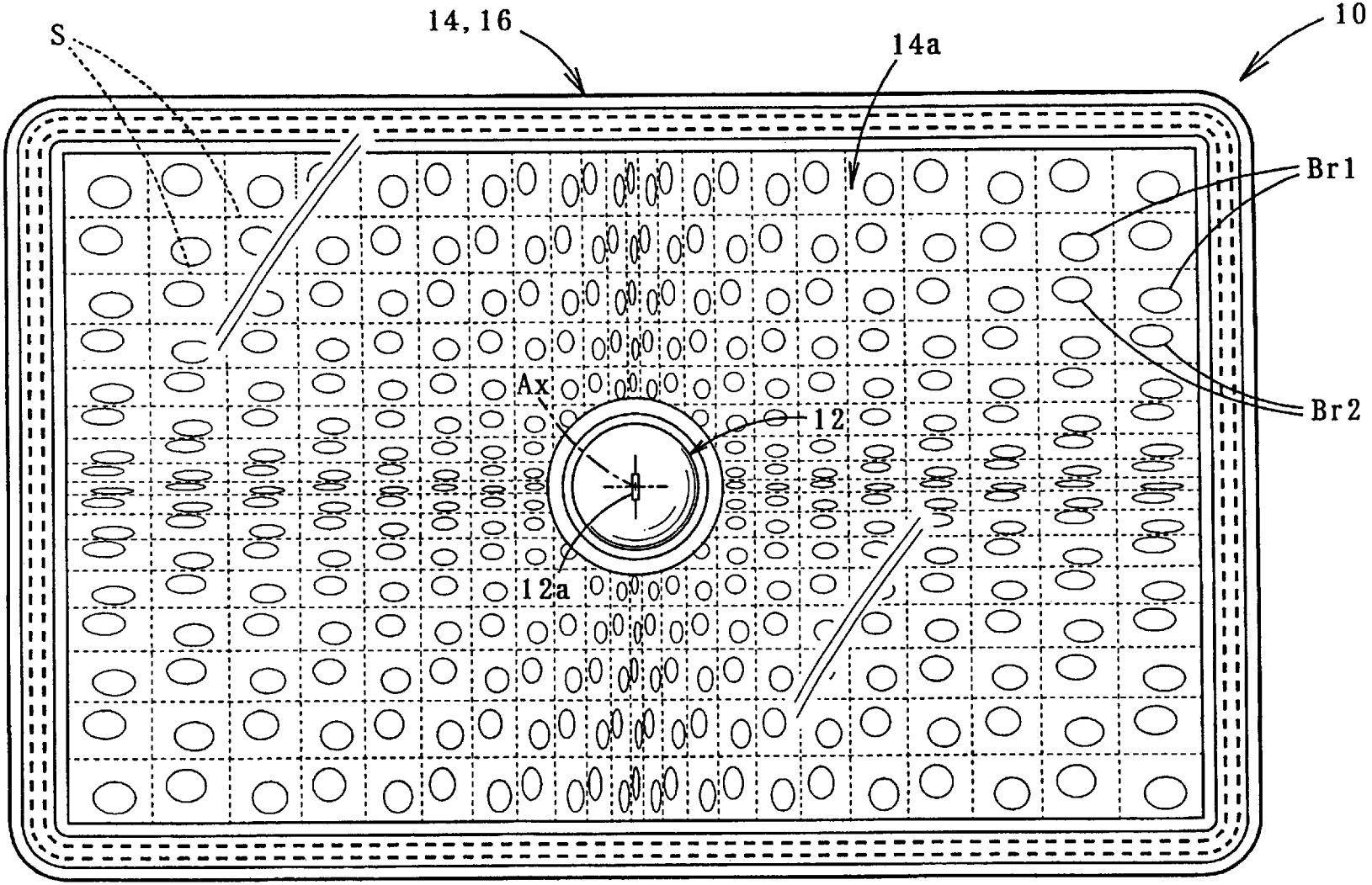
FIG. 7 is a view observed from the upper left of the lamp showing the appearance of the reflective surface in an ON state of the light source bulb in the first embodiment.

FIGS. 6 and 7 are views showing the appearance of the reflective surface 14*a* when the light source bulb 12 is turned ON. FIG. 6 is a view as seen from directly in front of the lamp. FIG. 7 is a view as seen from the top left of the lamp.

As shown in FIG. 6, when viewed from directly in front of the lamp, the concave surface reflective elements 14*s*1 and the convex surface elements 14*s*2 are visible as dot-like bright portions Br1 and Br2 substantially at the center of each segment S due to light reflected from the reflective elements 14*s*1 and 14*s*2. Moreover, a multiplicity of the bright portions Br1 and Br2 are visible shining in a scattered orthogonal grid pattern over the entire surface of the reflective element 14*a* in a manner whereby the bright portions Br1 and Br2 become gradually larger and positioned with gradually greater intervals therebetween the further they are from the optical axis Ax in both the vertical and horizontal directions.

If the point of observation is moved from the aforementioned state in the direction orthogonal to the optical axis Ax, the bright portions Br2 of the convex surface reflective elements 14*s*2 move in the same direction as the direction in which the point of observation has moved. In contrast, the bright portions Br1 of the concave surface reflective elements 14*s*1 move in the opposite direction to the direction in which the point of observation has moved. Therefore, if, for example, the point of observation is moved in the direction of the upper left of the lamp, bright portions Br1 and Br2 appear unevenly distributed in a regular pattern as shown in FIG. 7, and have a different appearance from when they are seen from directly in front of the lamp.

The brightness pattern (that is, the arrangement of the bright portions Br1 and Br2) of the reflective surface 2*a* changes dynamically as the point of observation changes and, moreover, is different depending on the direction in which the point of observation moves. As a result, a strong glittering sensation is perceived by the observer.

As has been described above in detail, in the vehicular indicator lamp 10 according to the present embodiment, the reflective surface 14*a* of the reflector 14 is formed by dividing the reflective surface 14*a* in an orthogonal grid pattern into a plurality of segments S, each of which is allocated a reflective element 14*s*1 or 14*s*2. In addition, the reflective. surface 14*a* is formed as a two-dimensional wavy surface on which concave surface reflective elements 14*s*1 and convex surface reflective elements 14*s*2 are alternately repeated in both directions of the orthogonal grid. With this arrangement, if the reflective surface 14*a* of the lamp is viewed from the front in its ON state, when the point of observation is moved vertically or horizontally, the brightness pattern of the reflective surface 14*a* changes dynamically to accompany the movement of the point of observation. This causes the observer to perceive a strong glittering sensation.

Even in the OFF state of the lamp, when light irradiated from outside the lamp is reflected by the reflective elements 14*s*1 and 14*s*2, the resultant brightness pattern changes as the point of observation moves. This makes it possible to cause the observer to perceive a strong glittering sensation.

Moreover, in the present embodiment because the reflective surface 14*a* is formed as a two-dimensional wavy surface over the entire surface thereof, it is possible to ensure the vertical and horizontal diffusion angles necessary to obtain the desired lamp light distribution at the point where the light is reflected from the reflector 14. As a result, the front lens 16 can be formed from a transparent lens, thereby ensuring the impression of clarity of the lamp.

Thus, according to the present embodiment, a visual impression of clarity of the lamp is ensured. Even if the point of observation is moved in either the vertical or horizontal direction, it is possible to provide a novel visual impression for the observer and, consequently, to improve the appearance of the lamp.

Furthermore, in the present embodiment, the pitch Pv of the segments S in the vertical direction and the pitch Ph of the segments S in the horizontal direction are set so as to gradually increase moving away from the optical axis Ax of the reflector 14 in the vertical and horizontal directions. The reflective surface 14*a* is thus seen shining in a scattered pattern as the bright portions Br1 and Br2 become gradually larger and the interval therebetween is increased away from the optical axis Ax. As a result, the observer has an impression of a lamp design having a sense of depth.

Moreover, in the present embodiment, the two-dimensional wavy surface forming the reflective surface 14*a* is formed with a paraboloid of revolution P as its reference surface having the optical axis Ax as a central axis. Reflected light from the reflector 14 is diffused in both vertical and horizontal directions around the optical axis Ax and consequently the desired lamp light distribution properties are easily obtained.

A second embodiment of the present invention next will be described.

Figure 8:
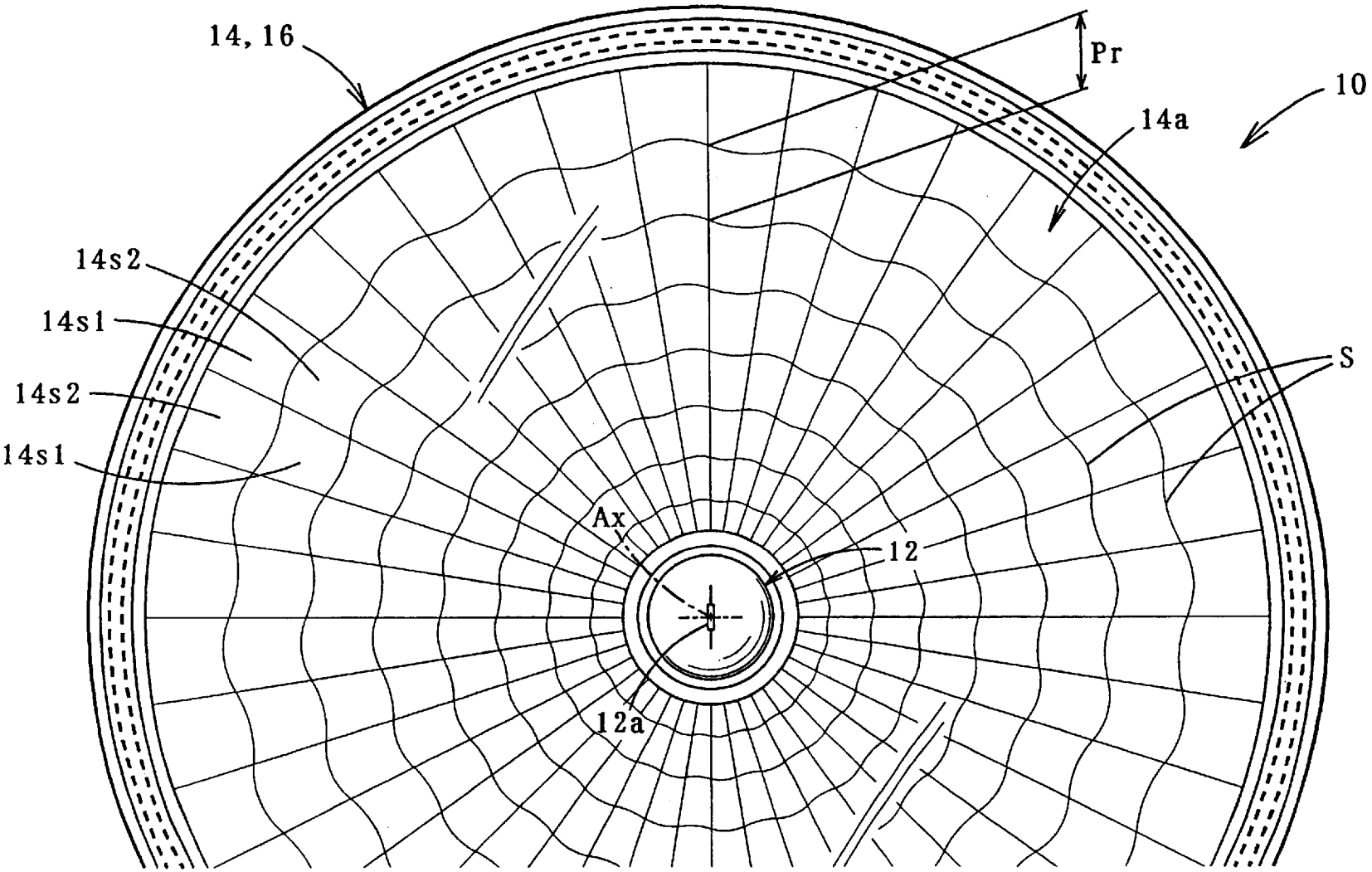
FIG. 8 is a front view showing a vehicular indicator lamp according to a second embodiment of the present invention.
Figure 9:
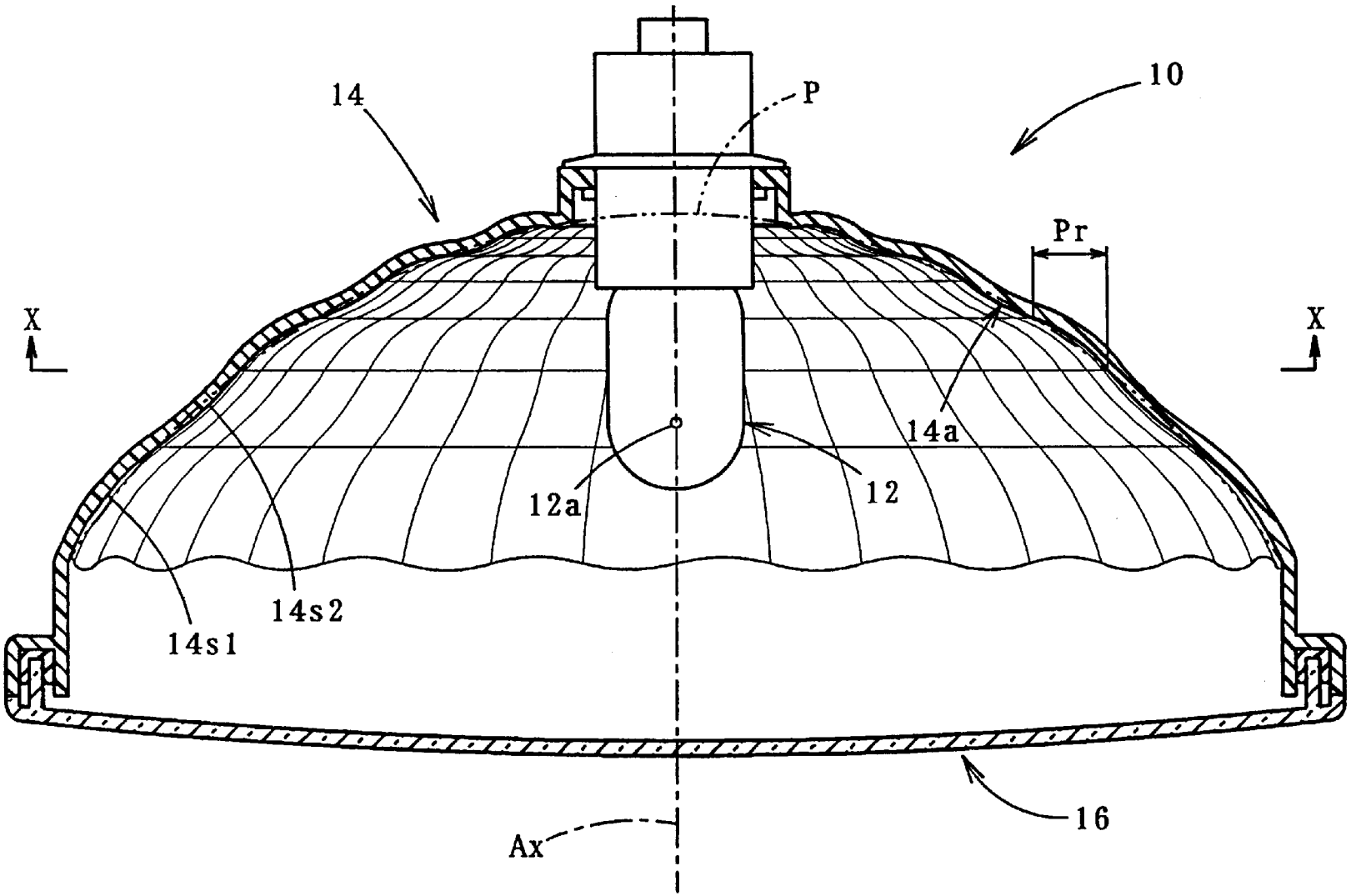
FIG. 9 is a top cross-sectional view showing the vehicular indicator lamp according to the second embodiment.
Figure 10:
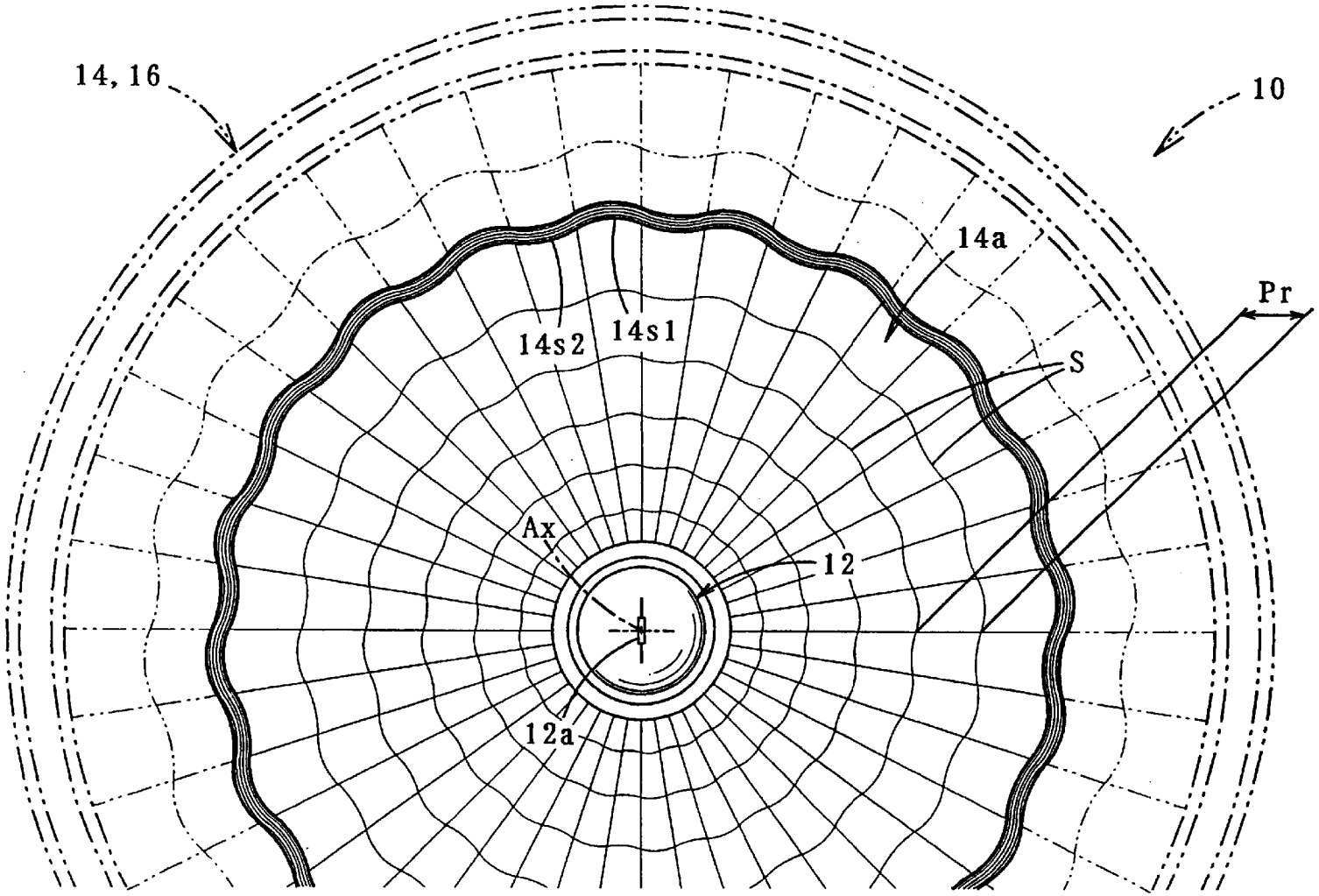
FIG. 10 is a cross-sectional view taken along a line X—X in FIG. 9.

FIG. 8 is a front view showing a vehicular indicator lamp constructed according to the second embodiment. FIG. 9 is a top cross-sectional view of the vehicular indicator lamp of FIG. 8. FIG. 10 is a cross-sectional view taken along a line X—X in FIG. 9.

As shown in these drawings, the basic lamp structure of the vehicular indicator lamp 10 according to this embodiment is the same as that of the first embodiment, except that it has a circular outer shape and employs an annular grid formed by dividing the reflective surface 14*a* into a plurality of segments S.

That is, in the second embodiment, the reflective surface 14*a* of the reflector 14 is divided into a plurality of segments S by the annular grid pattern formed by a plurality of straight lines arranged in a radial pattern centered on the optical axis Ax of the reflective surface 14*a* and by a plurality of concentric circles. The pitch Pr of the segments S in the radial direction is made gradually larger moving away in the radial direction from the optical axis Ax of the reflector 14.

Moreover, the reflective surface 14*a* is formed as a two-dimensional wavy surface on which each of the segments S is apportioned in the radial and circumferential directions into alternately repeated concave surface reflective elements 14*s*1 and convex surface reflective elements 14*s*2. Similar to the first embodiment, the two-dimensional wavy surface is formed with a paraboloid of revolution P as a reference surface having the optical axis Ax of the reflector 14 as a central axis and with the position of the filament 12*a* on the optical axis Ax being aligned with the focal point of the paraboloid of revolution.

Figure 11:
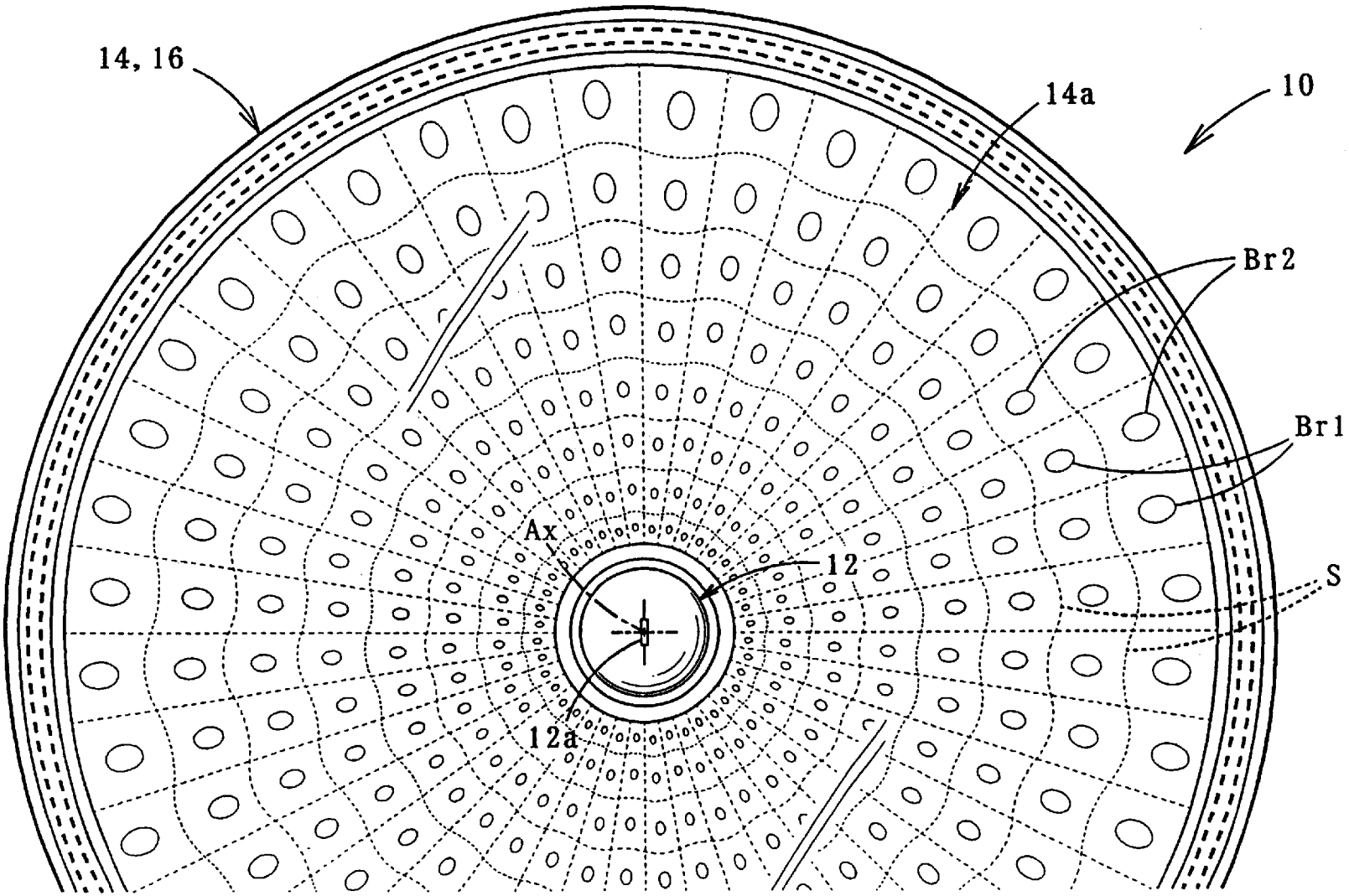
FIG. 11 is a front view showing the appearance of the reflective surface as seen from directly in front of the lamp in an ON state of the light source bulb in the second embodiment.
Figure 12:
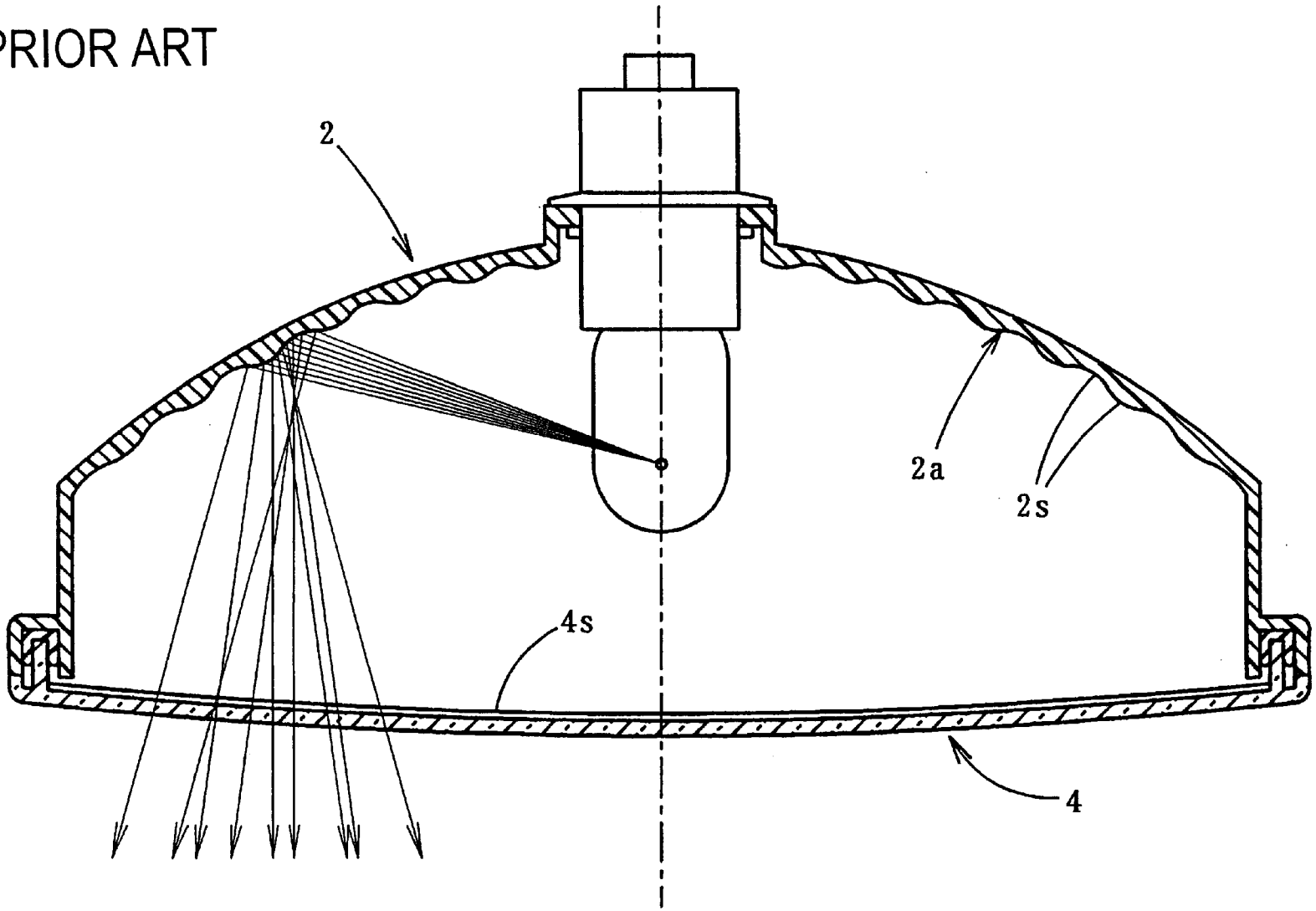
FIG. 12 PRIOR ART
FIG. 12 is a similar view to that shown in FIG. 2 of a conventional lamp.

FIG. 11 is a front view showing the appearance of the reflective surface 14*a* as seen from directly in front of the lamp in the ON state of the light source bulb 12.

As shown in the drawing, the concave surface reflective elements 14*s*1 and convex surface elements 14*s*2 are seen as dot-like bright portions Br1 and Br2 substantially at the center of the respective segments S due to the light reflected therefrom. Moreover, a multiplicity of bright portions Br1 and Br2 are visible in a scattered orthogonal grid pattern over the entire surface of the reflective surface 14*a* such that the bright portions Br1 and Br2 become gradually larger and positioned with gradually greater intervals therebetween the further they are from the optical axis Ax in both the radial and circumferential directions.

When moving the point of observation from the aforementioned position in a direction orthogonal to the optical axis Ax, the bright portions Br2 of the convex surface reflective elements 14*s*2 move in the same direction as the direction in which the point of observation moves. In contrast, the bright portions Br1 of the concave surface reflective elements 14*s*1 move in the opposite direction to the direction in which the point of observation moves. Therefore, the brightness pattern of the reflective surface 2*a* changes dynamically as the point of observation changes and, moreover, is different depending on the direction in which the point of observation moves. Thus, the observer perceives a strong glittering sensation.

Even in the OFF state of the lamp, when light irradiated from outside the lamp is reflected by the reflective elements 14*s*1 and 14*s*2, the resultant brightness pattern changes as the point of observation moves, causing the observer to perceive a strong glittering sensation.

Moreover, in the second embodiment, since the reflective surface 14*a* is formed as a two-dimensional wavy surface over the entire surface thereof, light reflected from the reflector 14 is diffused in the radial and circumferential directions around the optical axis Ax. As a result, it is possible to ensure the vertical and horizontal diffusion angles necessary to obtain the desired lamp light distribution pattern at the point where the light is reflected from the reflector 14. Consequently, the front lens 16 can be formed from a transparent lens, ensuring a visual impression of clarity of the lamp.

According to the second embodiment, the visual impression of clarity of the lamp can be ensured. Additionally, even if the point of observation is moved in either the vertical or horizontal direction, the observer is provided with a novel visual impression, thus improving the appearance of the lamp.

Furthermore, in the present embodiment the pitch Pr of the segments S in the radial direction gradually increases away from the optical axis Ax of the reflector 14 in the radial direction. The reflective surface 14*a* is visible shining in a scattered pattern with the bright portions Br1 and Br2 becoming gradually larger and the interval therebetween increasing in directions away from the optical axis Ax. This makes it possible to provide an impression to the observer of a lamp having a sense of depth.

Moreover, in the present embodiment, the two-dimensional wavy surface forming the reflective surface 14*a* is formed with a paraboloid of revolution P as its reference surface having the optical axis Ax as a central axis. Reflected light from the reflector 14 is diffused in both the radial and circumferential directions around the optical axis Ax, consequently easily providing the desired lamp light distribution properties.

It is noted that, for each of the above-described embodiments a description has been given assuming that the vehicular indicator lamp 10 is a tail lamp. However, it is possible to obtain the same operation and effects by employing the same structure as in the above embodiments in other types of vehicular indicator lamps.

What is claimed is:

1. A vehicular indicator lamp comprising:

a light source bulb;

a reflector having a reflective surface for reflecting light from said light source bulb in a forward direction, said reflective surface being divided into a plurality of segments in a grid pattern, said reflective surface being formed as a two-dimensional wavy surface, a reflective element being provided in each of said segments with concave surface reflective elements and convex surface reflective elements being alternatingly repeated in two directions along said grid pattern; and a front lens provided forward of said reflector.

2. The vehicular indicator lamp according to claim 1, wherein a pitch of said segments gradually increases in accordance with distance from an optical axis of said reflector.

3. The vehicular indicator lamp according to claim 1, wherein said reflective surface is formed with a paraboloid of revolution as a reference surface having an optical axis of said reflector as a central axis.

4. The vehicular indicator lamp according to claim 2, wherein said reflective surface is formed with a paraboloid of revolution as a reference surface having said optical axis of said reflector as a central axis.

5. The vehicular indicator lamp according to claim 1, wherein said front lens is a transparent lens.

6. The vehicular indicator lamp according to claim 1, wherein said grid pattern is formed by first and second sets of orthogonal lines.

7. The vehicular indicator lamp according to claim 1, wherein said grid pattern is formed by horizontal and vertical lines orthogonal to one another.

8. The vehicular indicator lamp according to claim 1, wherein said grid pattern comprises a slanted grid pattern formed by first and second sets of nonorthogonal slanted lines.

9. The vehicular lamp according to claim 1, wherein said grid pattern is formed by sets of concentric and radial lines.

10. The vehicular lamp according to claim 9, wherein said concentric lines are circular and said radial lines are straight.

11. The vehicular lamp according to claim 1, wherein adjacent ones of said reflective elements are joined together with no difference in height therebetween.

12. A vehicular indicator lamp comprising:

a light source bulb; and means for reflecting light from said light source bulb so as to cause an observer to perceive from a point of observation forward of said lamp a light pattern composed of a plurality of bright portions arranged in a grid, which pattern changes as said point of observation moves in both horizontal and vertical directions.

* * * * *